US008302685B2

(12) United States Patent
Reyes et al.

(10) Patent No.: US 8,302,685 B2
(45) Date of Patent: Nov. 6, 2012

(54) MUD PULSE TELEMETRY DATA MODULATION TECHNIQUE

(75) Inventors: Sandra Reyes, Issy les Moulineaux (FR); Remi Hutin, Bures sur Yvette (FR); Robert W. Tennent, Asker (NO); Christopher Paul Reed, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 478 days.

(21) Appl. No.: 12/363,092

(22) Filed: Jan. 30, 2009

(65) Prior Publication Data

US 2010/0195442 A1 Aug. 5, 2010

(51) Int. Cl.
*E21B 47/00* (2012.01)

(52) U.S. Cl. ..... 166/250.01; 340/853.1; 340/855.4; 367/81

(58) Field of Classification Search ..... 340/853.1, 340/855.4, 870.18, 870.25; 166/250.01; 367/81–84
See application file for complete search history.

(56) References Cited

U.S. PATENT DOCUMENTS

| | | | | |
|---|---|---|---|---|
| 3,309,656 | A * | 3/1967 | Godbey | 367/85 |
| 3,789,355 | A * | 1/1974 | Patton | 367/137 |
| 5,237,540 | A | 8/1993 | Malone | |
| 6,327,524 | B1 | 12/2001 | Chen | |
| 7,129,673 | B2 | 10/2006 | Eisnehardt et al. | |
| 2005/0263330 | A1 | 12/2005 | Gallagher et al. | |

FOREIGN PATENT DOCUMENTS

| | | |
|---|---|---|
| GB | 2087177 | 5/1981 |
| GB | 2361789 | 10/2001 |
| WO | 2006127760 | 11/2006 |

OTHER PUBLICATIONS

Borah, D.K., "Smooth Phase Interpolated Modulations for Nonlinear Channels," Proc. IEEE Global Communication Conv. GLOBCOM 2004, v. 1 pp. 10-14 (2004).

* cited by examiner

*Primary Examiner* — Kenneth L Thompson
*Assistant Examiner* — Ronald Runyan
(74) *Attorney, Agent, or Firm* — Chadwick A. Sullivan

(57) ABSTRACT

A technique for communicating data within a wellbore is provided. In one embodiment, a method includes receiving digital data and encoding the digital data into symbols each representative of one or more data bits of the digital data. In this embodiment, the method also includes modulating the phase of an acoustic wave within the wellbore to represent the plurality of symbols, wherein modulating the phase of an acoustic wave includes changing the phase of the acoustic wave such that the acoustic wave includes smooth phase transitions between successive phases representative of the plurality of symbols. Various additional methods, systems, and devices are also provided.

26 Claims, 4 Drawing Sheets

80

| BIT SEQUENCE (82) | SYMBOL (84) | PHASE (86) |
|---|---|---|
| 0 0 0 | 1 | $\pi/8$ |
| 0 0 1 | 2 | $3\pi/8$ |
| 0 1 1 | 3 | $5\pi/8$ |
| 0 1 0 | 4 | $7\pi/8$ |
| 1 1 0 | 5 | $9\pi/8$ |
| 1 1 1 | 6 | $11\pi/8$ |
| 1 0 1 | 7 | $13\pi/8$ |
| 1 0 0 | 8 | $15\pi/8$ |

MUD PULSE TELEMETRY DATA MODULATION TECHNIQUE

FIELD OF THE INVENTION

The present invention relates generally to well drilling operations and, more particularly, to data communications between downhole equipment and surface equipment during such drilling operations.

BACKGROUND OF THE INVENTION

During certain well drilling processes, it may be desirable to communicate information from the bottom of the wellbore to the surface. For instance, logging-while-drilling (LWD) and measurement-while-drilling (MWD) techniques may generally include the collection of a number of various measurements via one or more sensors within the wellbore. Data collected through such techniques may include measurements related to characteristics of the wellbore (e.g., azimuth and inclination) or drilling components (e.g., rotational speed) themselves, or measurements pertaining to the properties of geologic formations (e.g., density, pressure, or resistivity) proximate the wellbore, for example.

The measured data may be communicated to the surface through mud pulse telemetry techniques, in which drilling fluid or "mud" is used as a propagation medium for a signal wave, such as a pressure wave. More specifically, data may be communicated by modulating one or more features of the wave to represent the data. For instance, the amplitude, the frequency, and/or the phase of the wave may be varied such that each variation represents either a single data bit (i.e., binary modulation) or multiple data bits (i.e., non-binary modulation) of digital data. As the wave propagates to the surface, these modulations may be detected and the data bits may be determined from the modulations.

It is noted, however, that the characteristics of the downhole modulator used and the mud pulse telemetry channel itself may impact communication rates, power, bandwidth, and accuracy of various modulation techniques. For instance, in a phase shift keying (PSK) modulation technique digital data is generally impressed onto the wave in the mud by modulating the phase of the wave from within the wellbore. A demodulator at the surface detects the phase and reconstructs the digital data.

While PSK modulation generally calls for abrupt (in fact, instantaneous in the ideal case) changes of phase, it will be appreciated by those skilled in the art that the above-described modulator cannot generate instantaneous phase changes. Instead, mud pulse telemetry systems employing PSK modulation typically approximate the abrupt phase changes by making phase changes to the wave as quickly as mechanically allowed by the downhole modulator. Although controlling the modulator to implement phase changes as quickly as physically possible does enable data to be communicated via certain lower-order PSK techniques (e.g., binary PSK), it is believed that such control does not effectively allow data to be communicated via other higher-order PSK techniques (e.g., 8-PSK, in which eight discrete phases are used to represent various data groups having three bits each).

SUMMARY

Certain aspects of embodiments disclosed herein by way of example are summarized below. It should be understood that these aspects are presented merely to provide the reader with a brief summary of certain forms an invention disclosed and/or claimed herein might take, and that these aspects are not intended to limit the scope of any invention disclosed and/or claimed herein. Indeed, any invention disclosed and/or claimed herein may encompass a variety of aspects that may not be set forth below.

The present disclosure generally relates to techniques for communicating data by modulating an acoustic wave in a mud pulse telemetry system. In accordance with one disclosed embodiment, the acoustic wave is modulated to represent data in accordance with a PSK technique employing non-binary modulations with smooth transitions. In certain embodiments, the acoustic wave is further modulated in accordance with error checking and/or correction techniques, such as trellis coded modulation techniques.

Various refinements of the features noted above may exist in relation to various aspects of the present invention. Further features may also be incorporated in these various aspects as well. These refinements and additional features may exist individually or in any combination. For instance, various features discussed below in relation to one or more of the illustrated embodiments may be incorporated into any of the above-described aspects of the present invention alone or in any combination. Again, the brief summary presented above is intended only to familiarize the reader with certain aspects and contexts of embodiments of the present invention without limitation to the claimed subject matter.

BRIEF DESCRIPTION OF THE DRAWINGS

These and other features, aspects, and advantages of the present invention will become better understood when the following detailed description of certain exemplary embodiments is read with reference to the accompanying drawings in which like characters represent like parts throughout the drawings, wherein.

DETAILED DESCRIPTION OF SPECIFIC EMBODIMENTS

One or more specific embodiments of the present invention will be described below. These described embodiments are only examples of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, while the term "exemplary" may be used herein in connection to certain examples of aspects or embodiments of the presently disclosed subject matter, it will be appreciated that these examples are illustrative in nature and that the term "exemplary" is not used herein to denote any preference or requirement with respect to a disclosed aspect or embodiment. Further, any use of the terms "top," "bottom," "above," "below," other positional terms, and variations of these terms is made for convenience, but does not require any particular orientation of the described components.

Figure 1:
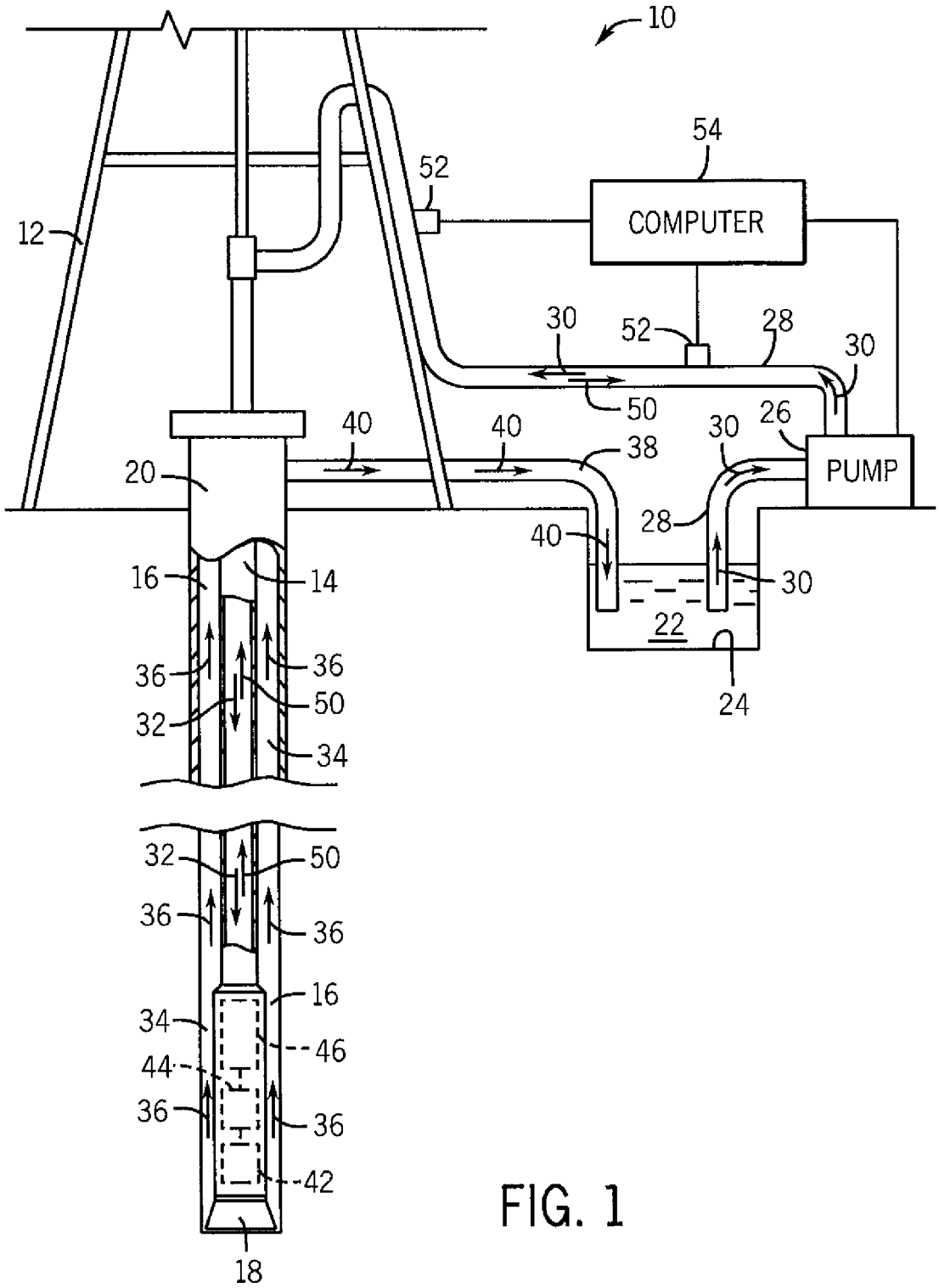
FIG. 1 is a schematic diagram generally depicting a well drilling system in accordance with one embodiment.

Turning now to the drawings, and referring first to FIG. 1, an example of a drilling system 10 adapted to communicate data via one or more mud pulse telemetry techniques is provided. While various elements of the drilling system 10 are depicted in FIG. 1 and generally discussed below, it will be appreciated that the drilling system 10 may include other components in addition to, or in place of, those presently illustrated and discussed. The system 10 may generally include a drilling rig 12 that supports a drill string 14 disposed within a wellbore 16. A drill bit 18 may be positioned at the end of the drill string 14, and may be configured to cut into geologic formations, thereby extending the depth of the wellbore 16. The presently illustrated system 10 also includes a casing 20 that generally maintains the structural integrity of the wellbore 16 near the surface.

During a drilling process, various debris (e.g., drill cuttings) may collect near the bottom of the wellbore 16. Additionally, the temperature of the drill bit 18 may increase due to friction between the drill bit 18 and the drilled geologic formation. Consequently, a drilling fluid 22, commonly referred to as drilling "mud", may be cycled through the wellbore 16 to remove such debris and facilitate cooling of the drill bit 18. In the presently illustrated embodiment, the drilling fluid 22 may be pumped from a reservoir or "mud pit" 24 and pumped through the wellbore 16 via a pump 26. More particularly, the pump 26 may route drilling fluid 22 through supply conduits 28 (e.g., pipes or hoses) to the drill string 14, as generally depicted by the arrows 30. The drilling fluid may flow downwardly through the drill string 14 to a distal end, as generally indicated by the arrows 32, and may exit the drill string 14 at or near the drill bit 18.

The drilling fluid 22 may then return to the surface through an annulus 34 generally defined between the circumference of the wellbore and the drill string 14, as indicated by arrows 36. Finally, the drilling fluid may exit the wellbore 16 via a return conduit 38, which routes the drilling mud 22 back to the reservoir 24 as generally depicted by arrows 40. In this manner, drilling fluid 22 routed through the wellbore 16 may cool the drill bit 18 and remove debris from the wellbore 16. Additionally, the debris in the drilling fluid 22 returning to the reservoir 24 from the wellbore 16 may settle to the bottom of the reservoir 24, allowing the drilling fluid 22 to be recycled through the wellbore 16.

As will be appreciated, various additional components and tools may be provided in the wellbore 16, such as components configured to facilitate MWD or LWD operations. In one embodiment, such additional components disposed in the wellbore 16 may include one or more data sources 42. The data sources 42 may include, for instance, various instruments or sensors configured to measure information relevant to a drilling process. Examples of such information include position data, orientation data, pressure data, and gamma ray data, although the use of sensors to measure other parameters is also envisaged.

Data collected from the one or more data sources 42 may be electronically transmitted to an assembly including an encoder 44 and a modulator 46, which cooperate to generate an acoustic wave (e.g., a pressure wave) and to vary aspects of the wave to represent the data from the one or more data sources 42, as discussed in greater detail below. The wave propagates through the drilling fluid 22 in the drill string 14 and the supply conduit 28 (which may include a standpipe of the drilling rig 12), as generally indicated by the arrows 50. The variations in the wave may be detected by one or multiple sensors 52 (e.g., pressure transducer(s)) at the surface of the system 10.

The detected variations may be processed by a computer 54 to reconstruct the original data from the one or more data sources 42. As will be appreciated, in one embodiment the computer 54 may include a processor configured to execute one or more programs stored within a memory of the computer to correlate the wave modulations with sequences of bits of the original digital data from the one or more data sources 42. It is further noted, however, that an application-specific integrated circuit may instead provide or supplement such functionality. Additionally, the computer 54 may also facilitate control and/or monitoring of other aspects of the system 10. For instance, in one embodiment, the computer 54 may facilitate control of the pump 26.

Figure 2A:
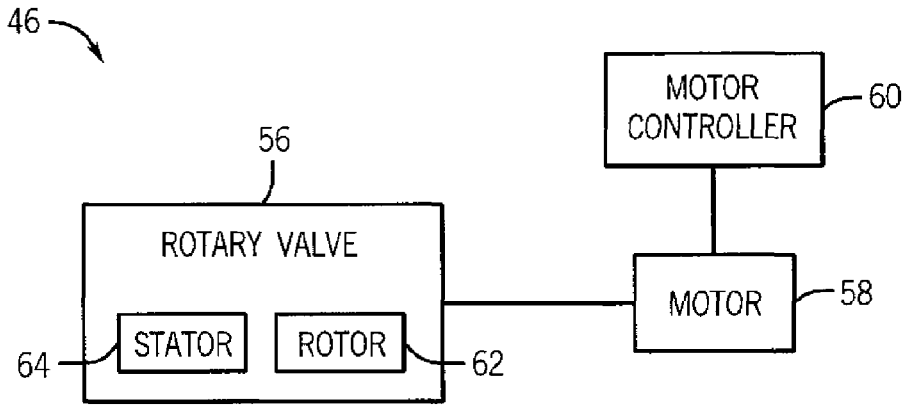
FIG. 2A is a block diagram of a pressure wave modulator having a rotary valve that may be used in the system of FIG. 1 in accordance with one embodiment.

Exemplary components of a modulator 46 are generally illustrated in FIG. 2A in accordance with one embodiment. It is noted, however, that various modulators for generating and modulating acoustic waves in mud pulse telemetry systems are known, and that the present techniques are not limited to the modulator 46 of the presently illustrated embodiment. The modulator 46 may include a rotary valve 56 coupled to a motor 58. A motor controller 60 may provide control signals to the motor 58, which may, in turn, apply a mechanical force to a rotor 62 of the rotary valve 56. In some embodiments, the mechanical force may drive the rotor 62, while in others (e.g., those in which the rotor 62 is driven by a turbine in response to a flow of fluid) the mechanical force may be used to apply a braking force to the rotor 62.

The rotor 62 may rotate with respect to a stator 64 of the rotary valve 56 to selectively inhibit the flow of drilling fluid 22 through the rotary valve 56 and to generate pressure pulses (e.g., the acoustic wave) as discussed above. For instance, the rotor 62 and the stator 64 may include complimentary openings that allow drilling fluid 22 to flow through the rotary valve 56 when the rotor 62 is oriented in an "open" position, and that prevent such flow when the rotor 62 is oriented in a "closed" position. In one embodiment, the selective inhibition of the flow of drilling fluid 22 results in a continuous pressure wave, having a period proportional to the rate of interruption, that propagates upwardly from the rotary valve 56 to the surface through the drilling fluid 22.

Figure 2B:
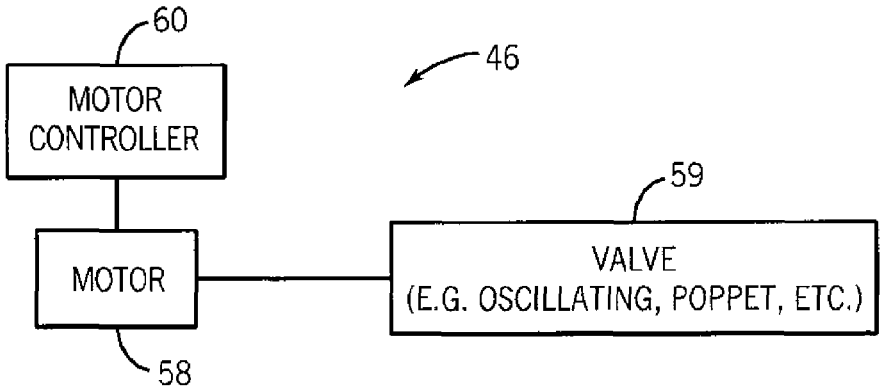
FIG. 2B is a block diagram of a modulator having a valve such as an oscillating valve or poppet style valve that may be used in the system of FIG. 1 in accordance with one embodiment.

FIG. 2B illustrates exemplary components of a modulator 46 in accordance with another embodiment. The modulator 46 may comprise any other style of valve 59, such as an oscillating valve, a poppet-style valve, or any other known or as-of-yet developed type of valve for mud pulse telemetry modulation. In such an embodiment, the motor controller 60 may provide control signals to the motor 58, which may, in turn, apply a mechanical force to change the position of the valve 59. For example, the motor controller 60 may cause the motor 58 to drive a poppet style valve to an open position or a closed position. In another example, the motor controller 60 may cause the motor 58 to control an oscillating valve to change from one position to another, or maintain a particular frequency of oscillation.

With fine control of the motor 58, the absolute position of the valves 56 and 59 discussed above may be better controlled. Any suitable motor control techniques may be employed in conjunction with the presently disclosed subject matter, including those disclosed in, for example, U.S. Pat. Nos. 6,327,524 and 7,129,673, and U.S. Pat. Appl. Pub. No. 2005/0263330, each of which is incorporated herein by reference in its entirety.

Figure 3:
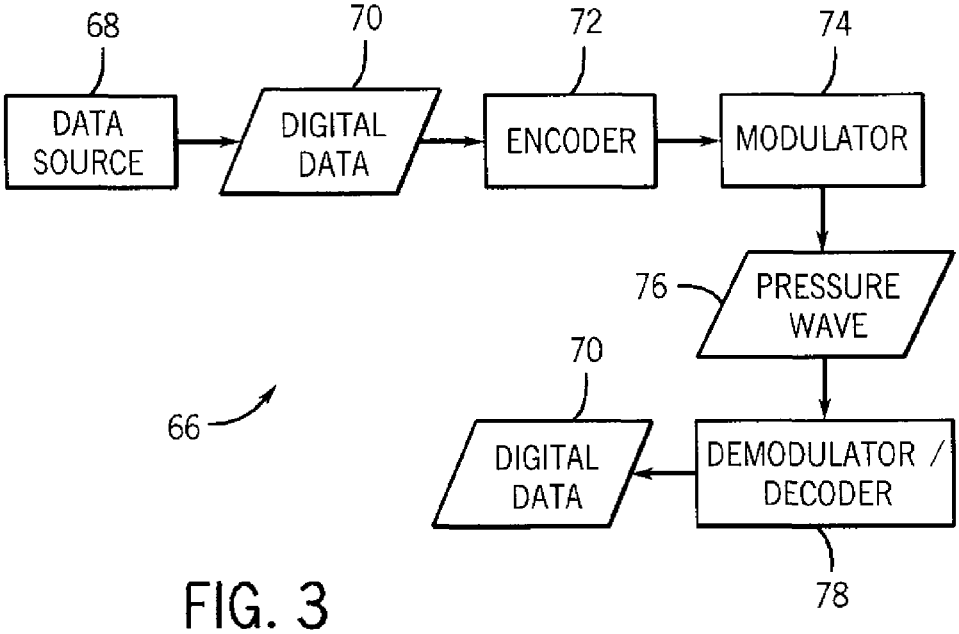
FIG. 3 is a block diagram illustrating components of an mud pulse telemetry system in accordance with one embodiment.

The modulation and demodulation of data, and communication of the data from the bottom of the wellbore 16 to the surface, is generally depicted in FIG. 3. As presently illustrated in FIG. 3, a data source 68 (e.g., a sensor or a memory device) may provide digital data 70 to an encoder 72. The encoder 72, in turn, may divide the data bits of the digital data 70 into groups of one or more data bits, and may associate the groups with distinct symbols (i.e., variations of the wave representative of groups of data bits). Depending on the modulation technique employed, the symbols representative of the groups may include variations of the phase, the frequency, and/or the amplitude of the wave, for example.

The modulator 74 is configured to modulate the pressure wave 76 in accordance with the symbols provided by the encoder 72. Although an example is provided below in connection with a PSK modulation technique, it is noted that numerous other modulation techniques could be employed in addition to, or instead of, PSK modulation. Examples of such other modulation techniques include amplitude modulation (AM), frequency modulation (FM), minimum shift keying (MSK), frequency shift keying (FSK), phase modulation (PM), continuous phase modulation (CPM), quadrature amplitude modulation (QAM), and trellis code modulation (TCM). The pressure wave 76 may then be received by a demodulator/decoder 78, such as the sensor 52 and computer 54 (FIG. 1), which may detect the modulations in the pressure wave 76, associate the modulations with the symbols, and reconstruct the original digital data 70 from such symbols.

A more detailed example of this process is described below with reference to FIGS. 4-6 in accordance with one embodiment. In this example, data is transmitted via the pressure wave 76 in accordance with a PSK technique, although it will be appreciated that other encoding techniques may also or instead be employed. More particularly, the present example is directed to communication of the data in accordance with an 8-PSK technique, generally represented in table 80 of FIG. 4. In this embodiment, the data bits of the digital data are grouped into three-bit groups, as generally indicated in column 82 of the table 80. Each possible bit sequence of such groups may be associated with a symbol, generally depicted in column 84, represented by modulating the pressure wave 76 to the corresponding phase depicted in column 86.

Figures 4, 5:
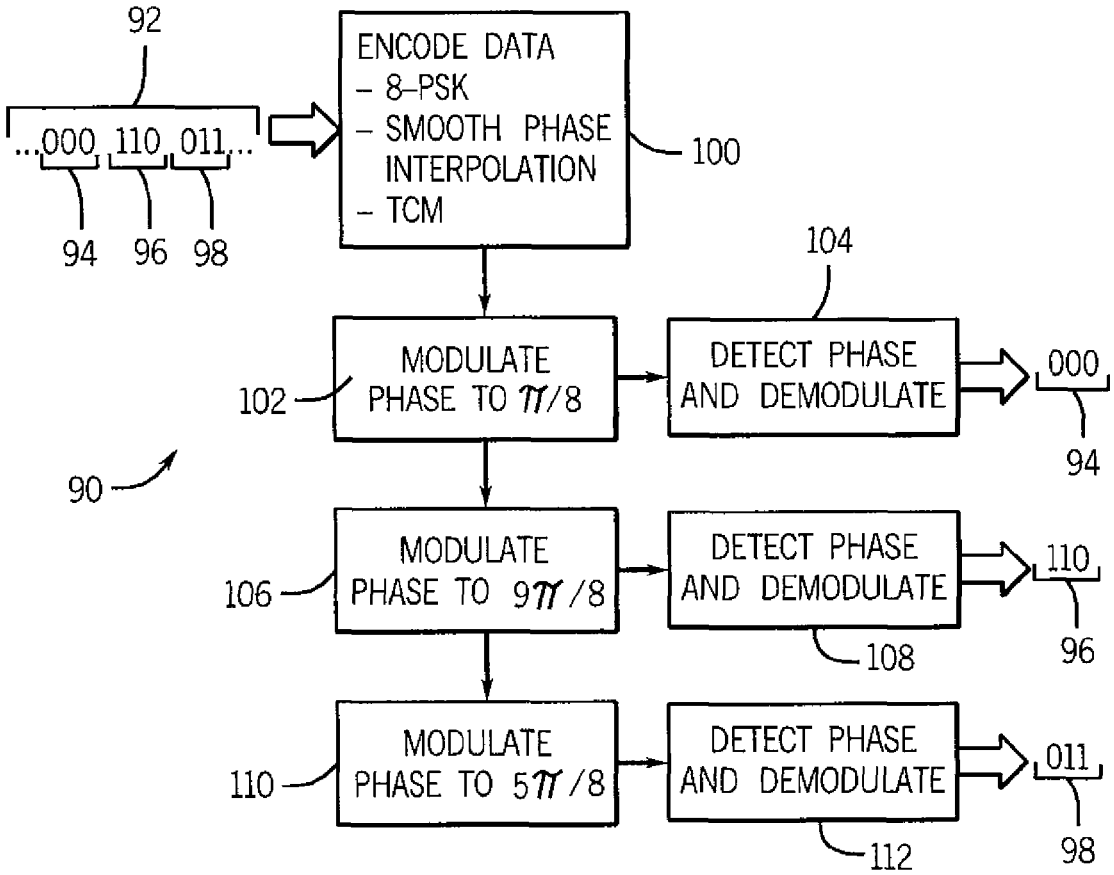
FIG. 4 is a table of bit sequences and corresponding symbols for varying a pressure wave in accordance with a phase shift keying modulation technique of one embodiment.
FIG. 5 is a flowchart of an example of a process for communicating digital data through modulation and demodulation of a pressure wave in accordance with one embodiment.

By way of further example, and as generally illustrated in FIG. 5, a portion 92 of a data stream of the digital data 70 may include a nine-bit data sequence of "000110011". This particular sequence of data may be divided into a group 94 of data bits "000", a group 96 of data bits "110", and a group 98 of data bits "011". These groups 94, 96, and 98 may then be encoded in a step 100 of a mud pulse telemetry process 90. In the present embodiment employing an 8-PSK technique, and with reference to the table 80, the group 94 may be associated with a first symbol of $\theta=\pi/8$. Similarly, the group 96 may be associated with a second symbol of $\theta=9\pi/8$, and the group 98 may be associated with an additional symbol of $\theta=5\pi/8$.

In addition to a PSK modulation technique, in some embodiments the data may also be encoded in accordance with a smooth phase interpolation technique, in which transitions between phases are made in a controlled and smooth manner, rather than made as quickly as mechanically allowed by the modulator 74. In one embodiment, the wave signal for a smooth phase PSK modulation may be represented as:

$$s(t) = \sqrt{\frac{2E_s}{T}} \cos(2\pi f_c t + q(t - nT, \sigma(n), \Theta_m(n)))$$

$$nT \le t \le (n+1)T$$

where the Es value is an energy per symbol, the t value is time, the T value is a symbol period, the fc value is a carrier frequency the q value is a transition function, the $\sigma(n)$ value is a state of a modulator at time nT and $\Theta_m$ is one of m discrete phase levels to be reached and the n value is the symbol rank/position in the transmission.

One way of generating the transition function, q(.), has been described in Borah, D. K., "Smooth Phase Interpolated Modulations for Nonlinear Channels", Proc. *IEEE Global Commun. Conf.*, GLOBECOM '2004, vol. 1, pp 10-14 (2004), which is incorporated herein by reference in its entirety. In some embodiments, the transition functions may take the full symbol period to reach the desired phase level. In other embodiments, however, transition functions using only a fractional portion of the symbol period, such as substantially equal to one-half or one-quarter of the symbol period, to reach the desired phase level may be employed. In addition, other ways of generating the phase transition are also envisioned.

In at least some embodiments, using smooth phase transitions may reduce the energy of the signal outside its main band. Such a reduction in the energy outside the main band of the signal may facilitate the sharing of the signal spectrum between multiple modulators without them interfering with each other. In addition, it is noted that using higher-order, M-ary, PSK techniques (e.g., 8-PSK rather than 4-PSK), wherein M represents the number of discrete phases, may also reduce the bandwidth of the signal for a fixed bitrate. Additionally, these smooth phase transition modulation techniques generally reduce the power requirements of, and mechanical strain on, the modulator. Consequently, higher telemetry rates and smaller bit error rates can be achieved.

Further, in some embodiments various error checking and/or correcting codes may also be incorporated in the modulation process. For instance, one embodiment may include the use of trellis coded modulation (TCM) in conjunction with an 8-PSK modulation technique, which may achieve a bit error rate of 0.01% at a relatively low signal-to-noise ratio of less than 6.5 dB, compared to the approximate 8.5 dB ratio that may be required to achieve the same error rate using 4-PSK alone, and the approximate 11.5 dB ratio that may be required to achieve the same error rate using 8-PSK alone. Still further, it is noted that in at least some embodiments, the use of absolute PSK modulation (in which each phase modulation is measured through comparison of a present phase to that of an original reference signal), rather than differential PSK (in which each phase modulation is measured through comparison of a present phase to that of the previous symbol) may further reduce the error rate when employing systematic convolutional error-correcting codes.

The method 90 of FIG. 5 may include modulating the pressure wave to a phase of $\pi/8$ in a step 102 to represent the group 94 of data bits. In a step 104, the phase of the pressure wave 76 may be detected and demodulated to reconstruct the data bit sequence "000" of the group 94. Similarly, to represent the group 96 of data bits, the phase of the pressure wave 76 may be modulated to $9\pi/8$ in a step 106. This modulation may be detected and demodulated in step 108 to reconstruct the data sequence "110" of the group 96. Likewise, in a step 110, the data of the group 98 may be represented by modulating the phase of the pressure wave 76 to $5\pi/8$, which may be then detected and demodulated in a step 112 to reconstruct the data sequence "011" of the group 98. Additional groups of data bits may be modulated and demodulated in a similar manner to allow the data to be communicated from the bottom of a wellbore to the surface. It is again noted that, in at least some embodiments, these modulations are made in accordance with a non-binary PSK (e.g., 8-PSK) modulation technique with smooth phase transitions (as discussed above), as well as a TCM modulation technique.

Figure 6:
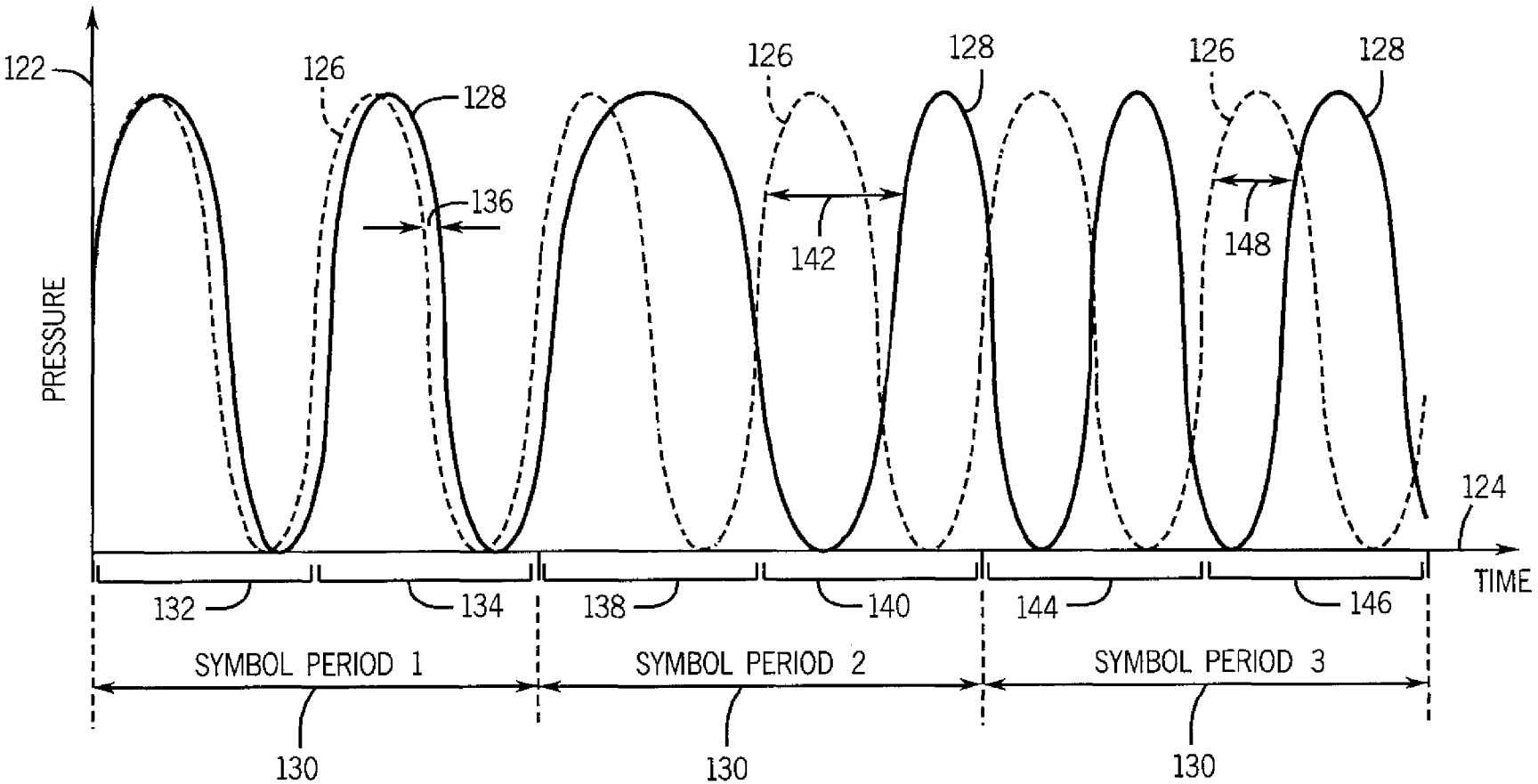
FIG. 6 is a graph depicting the modulation of the pressure wave via the process of FIG. 5 in accordance with one embodiment.

A graph 120 representative of the modulations discussed above with respect to steps 102, 106, and 110 is generally provided in FIG. 6. The graph 120 plots pressure as a function of time, as generally represented by the vertical and horizontal axes 122 and 124, respectively. A reference curve 126 corresponding to wave having a phase ($\theta$) equal to zero is included in the graph 120 to provide a clearer illustration of the phase-shift modulations of the pressure wave 76, which is generally represented by the curve 128. The graph 120 is generally divided into three symbol periods having substantially equal durations 130. The first symbol period includes a transition portion 132, during which the phase of the pressure wave 76 (represented by the curve 128) is modulated from a starting point of $\theta=0$, to $\theta=\pi/8$ representative of the group 94 of data ("000"). This phase shift of $\pi/8$ with respect to the reference curve 126 is generally indicated by arrow 136.

The phase of the pressure wave may be maintained at $\pi/8$ for the remaining portion 134 of the first symbol period, and may then be modulated in a transition portion 138 of the second symbol period to $\theta=9\pi/8$, which, as discussed above, generally represents the data sequence "110" of the group 96. Once this transition is complete (i.e., when the difference 142 between the curve 128 and the reference curve 126 is $9\pi/8$), the phase may be maintained at this level for the remaining portion 140 of the second symbol period. The pressure wave may again be modulated in a transition portion 144 of a third symbol period (e.g., from $\theta=9\pi/8$ to $\theta=5\pi/8$, representative of the data of group 98), and the phase of $5\pi/8$ may be maintained throughout the remaining portion 146 of the third symbol period. The phase of $5\pi/8$ is generally depicted as the difference 148 between the curves 126 and 128.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A mud pulse telemetry system comprising:

a pressure pulse generator disposed in a wellbore, the pressure pulse generator configured to generate a pressure wave in a drilling fluid disposed in the wellbore; and a data encoder disposed in the wellbore, the data encoder configured to receive digital data from a data source, to group data bits of the digital data into groups having one or more data bits, and to vary the phase of the pressure wave based on bit patterns of respective groups of data bits such that the phase of the pressure wave simultaneously encodes the one or more data bits of a group of data bits, and wherein the encoder is configured to perform a smooth phase PSK modulation according to $$s(t) = \sqrt{\frac{2E_s}{T}}\cos(2\pi f_c t + q(t - nT, \sigma(n), \Theta_m(n))) \quad nT \le t \le (n+1)T$$

where the Es value is an energy per symbol, the t value is time, the T value is a symbol period, the fc value is a carrier frequency the q value is a transition function, the $\sigma(n)$ value is a state of a modulator at time nT and $\Theta_m$ is one of m discrete phase levels to be reached and the n value is the symbol rank/position in the transmission;

wherein the pressure pulse generator is configured to modulate the pressure wave from a first phase encoding a first group of data bits of the digital data to a second phase encoding a second group of data bits of the digital data, and to modulate the pressure wave such that the pressure wave includes a smooth phase transition between the first phase and the second phase.

2. The mud pulse telemetry system of claim 1, wherein the encoder is configured to group the data bits of the digital data into groups of one or more data bits, and to associate each group of one or more data bits, and to associate each group of one or more data bits with a respective pressure wave phase value representative of the bit pattern of the group.

3. The mud pulse telemetry system of claim 1, comprising a data decoder configured to receive the pressure wave and to reconstruct the digital data from respective phases of the pressure wave.

4. The mud pulse telemetry system of claim 3, wherein the data decoder is configured to reconstruct the digital data from the pressure wave in the drilling fluid in accordance with a phase shift keying technique employing at least eight discrete phases.

5. The mud pulse telemetry system of claim 3, wherein the data decoder is configured to reconstruct the digital data from the pressure wave in the drilling fluid in accordance with an absolute phase shift keying technique.

6. The mud pulse telemetry system of claim 1, wherein the pressure pulse generator includes a continuous pressure wave generator.

7. The mud pulse telemetry system of claim 1, wherein the pressure pulse generator includes:

a valve disposed within a drill string and configured to selectively interrupt a flow of drilling fluid through the drill string to generate the pressure wave;

a motor coupled to the valve and configured to apply mechanical force to change the position of the valve; and a motor controller configured to output control signals to the motor to vary the position of the valve and the phase of the pressure wave.

8. The mud pulse telemetry system of claim 7, wherein the valve comprises one of a rotating valve, an oscillating valve, or a poppet valve.

9. The mud pulse telemetry system of claim 1, comprising the data source.

10. The mud pulse telemetry of claim 9, wherein the data source includes at least one sensor.

11. A mud pulse telemetry system comprising:

an encoder configured to perform a smooth phase PSK modulation according to a formula of $$s(t) = \sqrt{\frac{2E_s}{T}} \cos(2\pi f_c t + q(t - nT, \sigma(n), \Theta_m(n))) \quad nT \le t \le (n+1)T$$

where the Es value is an energy per symbol, the t value is time, the T value is a symbol period, the fc value is a carrier frequency the q value is a transition function, the σ(n) value is a state of a modulator at time nT and $\Theta_m$ is one of m discrete phase levels to be reached and the n value is the symbol rank/position in the transmission;

a modulator configured to be disposed within a drill string of a wellbore and to modulate the phase of a wave in a medium within the drill string; and a demodulator configured to receive the wave through the medium;

wherein the modulator and demodulator are configured to modulate and demodulate, respectively, the phase in accordance with an M-ary phase shift keying technique in which transitions between successive phases of the wave are interpolated such that the transitions between the successive phases include smooth phase transitions, wherein M Is an integer that is equal to or greater than eight.

12. The mud pulse telemetry system of claim 11, wherein the modulator and demodulator are respectively configured to modulate and demodulate the phase in accordance with a trellis modulation technique.

13. The mud pulse telemetry system of claim 11, wherein the modulator comprises one of a rotating valve, an oscillating valve, or a poppet valve; the modulator configured to be driven by a motor controlled by a motor controller.

14. The mud pulse telemetry system of claim 11, wherein the modulator is configured to receive the digital data, to group data bits of the digital data into groups having three or more data bits, and to vary the phase of the pressure wave based on bit patterns of respective groups of data bits such that the phase of the pressure wave simultaneously encodes the three or more data bits of a group of data bits.

15. A method of communicating data within a wellbore, the method comprising:

receiving digital data;

encoding the digital data into a plurality of symbols, each symbol representative of one of more data bits of the digital data wherein the digital data is encoded to achieve a smooth phase PSK modulation according to a formula of $$s(t) = \sqrt{\frac{2E_s}{T}} \cos(2\pi f_c t + q(t - nT, \sigma(n), \Theta_m(n))) \quad nT \le t \le (n+1)T$$

where the Es value is an energy per symbol, the t value is time, the T value is a symbol period, the fc value is a carrier frequency the q value is a transition function, the σ(n) value is a state of a modulator at time nT and $\Theta_m$ is one of m discrete phase levels to be reached and the n value is the symbol rank/position in the transmission; and modulating the phase of an acoustic wave within the wellbore to represent the plurality of symbols, wherein modulating the phase of an acoustic wave includes changing the phase of the acoustic wave such that the acoustic wave includes smooth phase transitions between successive phases representative of the plurality of symbols.

16. The method of claim 15, wherein modulating the phase of the acoustic wave includes modulating the phase in accordance with an error correction technique.

17. The method of claim 16, wherein modulating the phase in accordance with an error correction technique includes modulating the phase in accordance with a trellis coded modulation technique.

18. The method of claim 15, comprising generating the acoustic wave at a first location and receiving the acoustic wave at a second location.

19. The method of claim 18, comprising demodulating the acoustic wave received at the second location.

20. The method of claim 19, wherein demodulating the acoustic wave includes detecting absolute phase modulations of the acoustic wave and associating each of the absolute phase modulations to one symbol of the plurality of symbols.

21. The method of claim 19, wherein generating the acoustic wave includes generating a continuous acoustic wave.

22. The method of claim 15, wherein modulating the phase of the acoustic wave includes modulating the phase such that the acoustic wave includes a plurality of symbol periods of equivalent duration, each symbol period including a transition time interval for transitioning between phases.

23. The method of claim 22, wherein modulating the phase of the acoustic wave includes modulating the phase such that the duration of the transition time interval is less than or equal to that of the symbol period.

24. The method of claim 23, wherein modulating the phase of the acoustic wave includes modulating the phase such that the duration of the transition time interval is substantially equal to half the duration of the symbol period.

25. A mud pulse telemetry system comprising:

a modulator configured to be disposed within a drill string of a wellbore and to modulate the phase of a wave in a medium within the drill string;

an encoder configured to perform a smooth phase PSK modulation according to a formula of:

$$s(t) = \sqrt{\frac{2E_s}{T}} \cos(2\pi f_c t + q(t - nT, \sigma(n), \Theta_m(n))) \quad nT \le t \le (n+1)T$$

where the Es value is an energy per symbol, the t value is time, the T value is a symbol period, the fc value is a carrier frequency the q value is a transition function, the σ(n) value is a state of a modulator at time nT and $\Theta_m$ is one of m discrete phase levels to be reached and the n value is the symbol rank/position in the transmission;

and a demodulator configured to receive the wave through the medium; wherein the modulator and demodulator are configured to modulate and demodulate, respectively, the phase in accordance with an M-ary phase shift keying technique in which transitions between successive phases of the wave are interpolated such that the transitions between the successive phases include smooth phase transitions, wherein M is an integer that is equal to or greater than two.

26. The mud pulse telemetry system of claim 25, wherein the modulator is configured to receive the digital data, to group data bits of the digital data into groups having one or more data bits, and to vary the phase of the pressure wave based on bit patterns of respective groups of data bits such that the phase of the pressure wave simultaneously encodes the one or more data bits of a group of data bits.

* * * * *